US009462849B2

(12) United States Patent
Trauner

(10) Patent No.: US 9,462,849 B2
(45) Date of Patent: Oct. 11, 2016

(54) ADHESIVE FOOTWEAR AND DEVICES

(71) Applicant: Kenneth B Trauner, San Francisco, CA (US)

(72) Inventor: Kenneth B Trauner, San Francisco, CA (US)

(73) Assignee: Kenneth B. Trauner, San Francisco, CA (US)

( * ) Notice: Subject to any disclaimer, the term of this patent is extended or adjusted under 35 U.S.C. 154(b) by 639 days.

(21) Appl. No.: 13/886,600

(22) Filed: May 3, 2013

(65) Prior Publication Data

US 2013/0291410 A1 Nov. 7, 2013

Related U.S. Application Data

(60) Provisional application No. 61/642,059, filed on May 3, 2012.

(51) Int. Cl.

| | |
|---|---|
| ***A43B 13/12*** | (2006.01) |
| ***A43B 13/32*** | (2006.01) |
| ***A43B 3/10*** | (2006.01) |
| ***A43B 5/18*** | (2006.01) |

(52) U.S. Cl.

CPC ..... *A43B 13/32* (2013.01); *A43B 3/10* (2013.01); *A43B 5/18* (2013.01); *A43B 13/12* (2013.01)

(58) Field of Classification Search

CPC ..... A43B 3/10; A43B 3/102; A43B 5/18; A43B 13/32; A43B 13/12

USPC ..... 36/11.5

See application file for complete search history.

(56) References Cited

U.S. PATENT DOCUMENTS

| | | | | | |
|---|---|---|---|---|---|
| 2,408,152 | A * | 9/1946 | Porcelli | A43C 15/02 | 152/208 |
| 2,985,970 | A * | 5/1961 | McCarthy | A43B 13/00 | 12/142 R |
| 3,595,244 | A * | 7/1971 | Kugler | A43B 7/146 | 36/11.5 |
| 5,146,698 | A * | 9/1992 | Tilles | A43B 13/40 | 36/178 |
| 5,694,704 | A * | 12/1997 | Kasbrick | A43B 3/16 | 36/59 R |
| 6,453,578 | B1 * | 9/2002 | Yung | A43B 7/142 | 36/166 |
| 2004/0006814 | A1 * | 1/2004 | Holden | A41D 13/06 | 2/455 |
| 2006/0037214 | A1 * | 2/2006 | Goggin-Lewis | A43B 3/106 | 36/11.5 |

* cited by examiner

*Primary Examiner* — Ted Kavanaugh
(74) *Attorney, Agent, or Firm* — Staniford Tomita LLP

(57) ABSTRACT

Footwear used for high performance activities such as running can be adhesively attached to the plantar surface of feet rather than uppers or straps. The upper surface of the protective layer of the footwear can have adhesive regions that secure the foot to the footwear and other regions that are not adhesively coupled to the foot. The adhesive regions can be under the heel, along the lateral side of the foot, under the first through fifth metatarsophalangeal (MTP) joints and around the perimeter of the foot above the plantar surface.

8 Claims, 15 Drawing Sheets

ADHESIVE FOOTWEAR AND DEVICES

CROSS REFERENCE TO RELATED APPLICATIONS

This application claims priority to U.S. Provisional Application No. 61/642,059, Adhesive Shoe And Devices, filed May 3, 2012, which is hereby incorporated by reference in its entirety.

BACKGROUND

This invention relates to an adhesive shoe or artificial sole. There are many situations in which a person may wish to walk barefoot but with foot protection. This foot protection can include the benefits of the lower sections of the shoe but without the hindrances of the top of the shoe. No shoes currently exist that perform in a way that mimics the natural performance of the bare human foot. All existing shoes or foot protection devices such as sandals without tops alter gait, are not resilient and have uncomfortable features, and are not functional for higher demand activities.

For example, in warmer climates, sandals are frequently worn with various dorsal mechanical restraints to keep the shoe on the foot. Topless sandals have been available with uniform thickness soles and uniform adhesive applied to the top of the sandal where the upper surface contacts the foot. These sandals are not sufficiently durable at the interface for use in an array of activities and are prone to third body interposition in the interface and discomfort. The limits of existing adhesive designs also require alteration of gait to maintain sandal adherence.

There is a trend towards increased barefoot activity as a way of developing foot strength. These "minimalist" shoes allow the muscles in the foot to gain strength by providing less constriction to the foot. Long-term use of more rigid running shoes is now seen as potentially damaging to the knees. Thus, runners are being encouraged to cross train with shoes that more closely mimic barefoot running. There are also many situations in which improved protection and support is required for the bottom of the foot to protect from injury.

There is a need for footwear applied to the plantar surface of the foot which is functional in a variety of physical environments and suitable for higher demand activities. These higher performance activities include use in water, sand, paved surfaces, etc. The protector needs to support the dynamic structural requirements for a variety of physical exertions including running, jumping, swimming, diving, jogging, etc.

SUMMARY OF THE INVENTION

This invention describes footwear having an artificial sole that is adhesively attached to the foot or an adherent shoe that incorporates various features to more closely facilitate normal gait and to mimic the experience of walking barefoot. This footwear can be used for high performance and high demand activities. In addition this invention offers the improvements over walking barefoot of offering structure support and protection for the foot throughout gait.

The inventive footwear also incorporates features that allow it to be worn in wet or sandy environment. The inventive footwear can differ from the prior art because it can provide a minimal amount of adhesive contact with the foot that is still sufficient for the high performance activity that the footwear is being used for.

Adhesives applied to most or all of the skin on the bottom of the foot can provides discomfort in sensitive portions of the foot. Previous designs do not provide additional support for the foot biomechanically. This invention describes and adherent shoe that offers improved biomechanics for more normal gait, that minimizes the amount of adhesive area required for stability of the shoe, that applies in zones of the foot that maximize stability and minimize discomfort, that prevents interposition of foreign bodies in the shoe/foot interface and that more closely mimics the barefoot walking experience.

The present invention also describes footwear that specifically avoids the use of adhesives and tacking adhesive and adhesives chemicals though use of structural modifications of the surface of the contact zones. In an embodiment, the upper surface of the footwear that contact the bottom of the user's feet can rely upon Van der Waal forces of high surface area structures to generate atomic adherence forces for adherence. For example, the adhesive material can be a polymer material with the ability to provide glue-free bonding of the footwear to the foot. The footwear can be removed by de-bonding the glue-free adhesive. In an embodiment, the adhesive material surface can be covered with a pattern of microstructures, which may resemble the geometry of tenent hairs. This adhesive material can be less sensitive to contamination by dust particles than commercially available pressure-sensitive adhesives. Even if the material is contaminated, the adhesive surface can be washed with a soap solution in water, in order to completely recover its adhesive properties.

The adhesives can be placed on key locations of the upper surface of the footwear and these adhesive areas can provide at least the minimal adhesion necessary for successful and prolonged adherence during rigorous use. For example, the adhesive regions can include the heel, the lateral side of the foot and a region defined by a border around the first through fifth metatarsophalangeal (MTP) joints. Adhesives can be avoided on the arch region of the foot. Adhesive regions may be placed under the lower contact areas of the toes. However, the areas under the middle sections of the toes should be free of adhesives. In an embodiment, the footwear can include a raised peripheral regions and an adhesive can be used to couple the inner surface of the raised peripheral regions to the outer side surfaces of the foot. The peripheral adhesion may include the heel but may exclude the toes.

In an embodiment, the adhesive regions can be formed from a thin adhesive material that has a lower surface that is in direct contact with the upper surface of the protective layer and an upper surface that is in direct contact with the foot. The adhesive regions can be formed in recessed areas of the upper surface of the protective layer so that the upper surface of the adhesive regions can be planar and even with the upper surface of the protective layer. Alternatively, the protective layer may not have recessed areas of the upper surface and the adhesive regions can be higher than the upper surface of the protective layer or the upper surface of the adhesive regions can have a ruffled texture that is uneven, which can make the adhesive regions breathable.

The adhesive regions can have shapes that correspond to the heel in the calcaneal area and the lateral side of the foot and the region under the first through fifth MTP joints. If the adhesive regions need to be replaced, the adhesive layers can be removed from the protective layer and replaced. In other embodiments, the adhesive regions can be uniform in shape such as a circle. The user can place the adhesive members in the desired locations on the upper surface of the protective layer avoiding the arch and middle toe areas. In an embodiment, a supply of adhesive members can be supplied to the user. For example, if the adhesive members are circular, the supply can be stored in a cylindrical stack from which individual adhesive members can be removed and used.

In an embodiment, the adherent qualities of the adhesive regions may vary by location. Some adhesive regions can have a strong adhesive bonding on areas where shear movement should be minimized such as under the heel. However, other adhesive regions can have lower strength adherent qualities. For example, in an embodiment the raised edges of the footwear may be intended to keep debris away from the foot and may be have a lower strength adhesive. Thus, the adhesive regions can be non-uniform in adherence. Various types of adhesives can be suitable for the inventive footwear. For example, the adhesion mechanism can utilize Van der Waal force adhesion, which does not use glues or chemicals that can leave residue. Other suitable adhesives include surgical skin adhesives that can be in the form of pressure-sensitive adhesive tape that can have a hypoallergenic adhesive. This adhesive tape can be elastic and breathable.

In an embodiment, the protective layer of the footwear can have a non uniform thickness with a heel cup having additional padding, the arch and mid foot having less padding thicknesses and the toes having even less padding. The variable thickness of the footwear can range from about 5-20 mm. In an embodiment, the thickness of the protective layer of the can mimic the natural padding of the foot.

In an embodiment, the some or all of the perimeter of the footwear can have upward raised edges. The raised edges may surround the rear foot and extend forward to the toes. The raised edges may be omitted from the front portion of the footwear adjacent to the toes. The raised edges can improve the stability of the footwear by preventing the foot from sliding over the edges of the footwear.

In an embodiment, the inventive footwear can include flexible elastic tabs that can be thin high tensile strength structures that are attached to portions of the perimeter of the footwear or the raised edges of the footwear. The tabs can wrap over top and/or side portions of the foot to more securely attach the footwear to the foot. In an embodiment, the tabs can be replaceable. If the tab structure or the adhesive fails and needs to be replaced, the tab can be removed from the footwear and replaced. In an embodiment, the tab can be attached to the footwear mechanically or with an adhesive that is different than the adhesive used to attach the footwear to the user's foot. The replacement tabs can be inserted into slots along one or more edges of the protective layer of the footwear.

In an embodiment, the inventive footwear can include an arch support that can be integrated into the footwear. In an alternative embodiment the arch support can be a modular structure that is adhesively attached to the upper surface of the protective layer. The arch support can be an elastic structure that can compress or expand with the movement of the foot. The arch support can include a plurality of fenestrations that can be arranged in a radial pattern across the width of the footwear. In a preferred embodiment, the upper surface of the arch support is not adhesive and can slide against the bottom of the foot. The arch support can improve the comfort of the inventive footwear.

In an embodiment, the inventive footwear can also include ventilation holes in the upper surface of the protective layer. The holes can be connected to internal holes that extend through the length and/or width of the protective layer to other openings. The compression of the protective layer while the user walks or runs can cause the ventilation holes to expand and contract which can cause air circulation on the bottom of the foot as well as drainage.

DETAILED DESCRIPTION OF INVENTION

Figure 1:
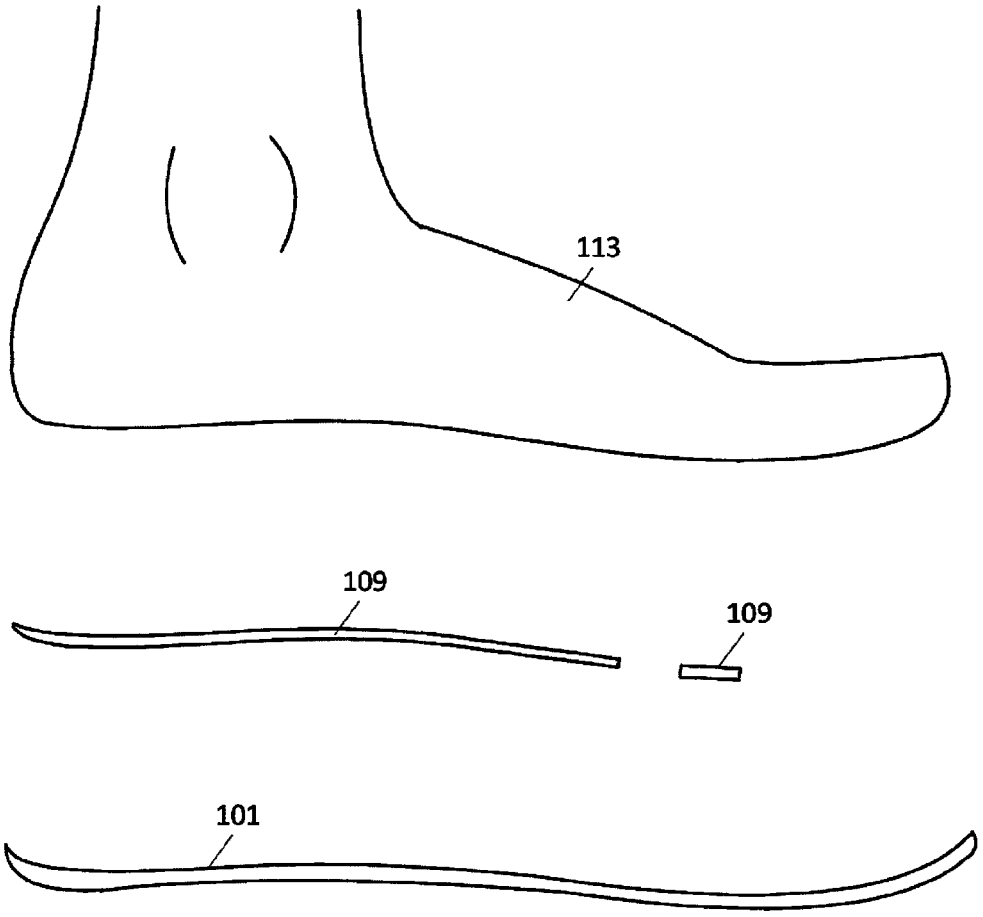
FIG. 1 illustrates an exploded side view of an embodiment of the inventive footwear.

With reference to FIG. 1, an exploded view of the components of the present invention is illustrated. The illustrated footwear can include a protective layer 101 and a plurality of adhesive regions 109 that are used to attach the protective layer 101 to a plantar surface 111 of a foot 113.

Figure 2:
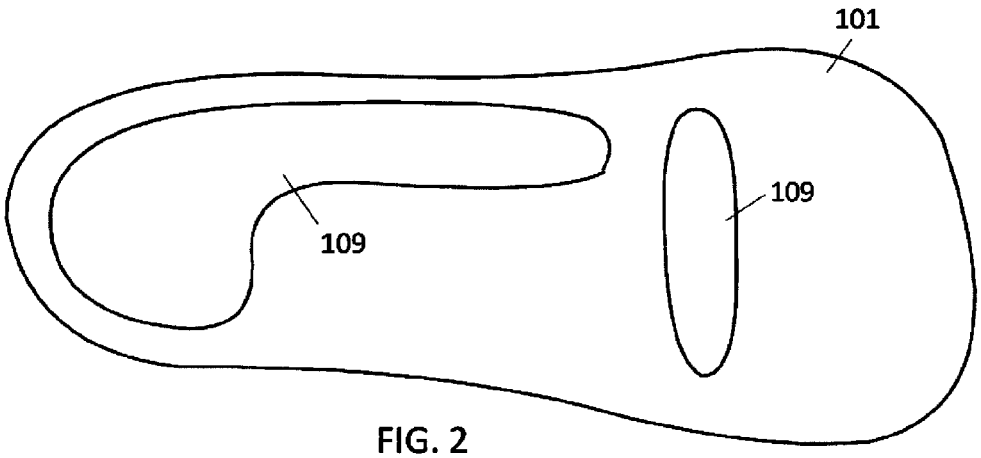
FIG. 2 illustrates a top view of an embodiment of the inventive footwear having different peripheral features.

The inventive footwear is designed for high performance activities including: running, hiking, beach activities, water sports such as swimming, surfing, paddling, etc. The footwear has a sole or protective layer 101 that has an upper surface 103 that can conform to the plantar surface 111 of the foot 113. With reference to FIG. 2, a top view of an embodiment of the inventive footwear is illustrated with the plurality of adhesive regions 109 placed on specific areas of the upper surface 103 of the protective layer. In this embodiment, the adhesive regions 109 are placed on portions of the upper surface 103 that correspond to the ball region of the foot from the first metatarsal head to the fifth metatarsal head and a rear region of the foot that includes the heel and a lateral side of the foot. The adhesive regions 109 do not include areas of the upper surface 103 that correspond to the arch of the foot or in this embodiment the toes.

A protective layer having an upper surface that is completely covered with an adhesive to attach the footwear to the foot can be problematic. Experimentation has demonstrated that adhesives used on specific zones of the foot interfere with certain motions and generate shear at the skin that can cause foot discomfort and blistering. Specific examples of problem areas include adhesive in the region of the arch of the foot and on the undersurface of the toes. The area under the arch is sensitive to shear forces and similarly, the toes may require freedom of movement while walking and running.

The present invention describes a plurality of configurations that can each be used to provide maximum stability while minimizing the size of the adherent regions on the shoe. Minimizing the extent of the adherence has been shown to markedly improve the comfort to the wearer. As discussed above, those areas constitute the area on the ball of the foot, the heel of the foot and in a zone along the lateral side of the plantar foot. In an embodiment, the plurality of adhesive regions can cover less than 40% of the upper surface of the protective layer.

Figure 3:
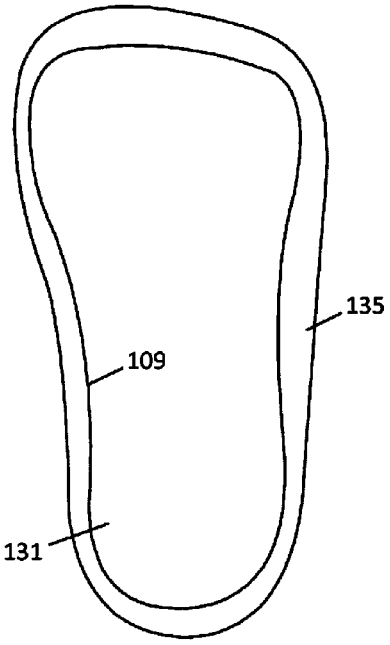
FIGS. 3-6 illustrate top views of different embodiments of the inventive footwear.
Figure 4:
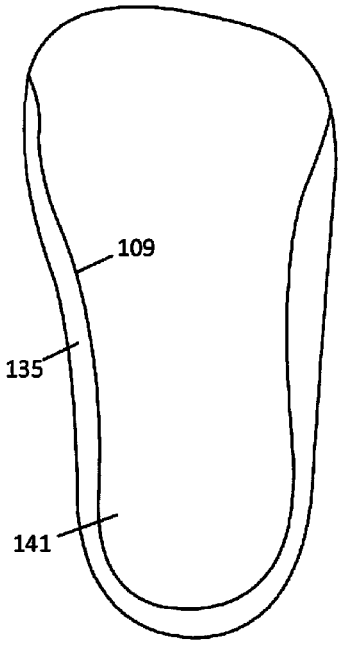

For higher demand activities, the protective layer can extend upwards around portions of the perimeter of the foot. With reference to FIGS. 3-6, embodiments of the inventive footwear are illustrated. For simplicity, the adhesive regions 109 on the upper surfaces of the protective layers are not illustrated. With reference to FIG. 3, an embodiment of the protective layer 131 is illustrated with an upward extending member 135 that extends around the entire perimeter of the foot. The inner surfaces of the upward extending member 135 can have adhesive regions 109 that are used to attach the protective layer 131 to the sides of the feet above the plantar surface. With reference to FIG. 4, an embodiment of the protective layer 141 is illustrated with an upward extending member 135 extending around the rear foot portion of the foot and the sides of the forefoot. The upward extending member 135 does not extend across the front of the toes. The upward extending members can provide additional stabilizing surfaces along the posterior aspect of the heel for increase stability for high demand activities.

Figure 5:
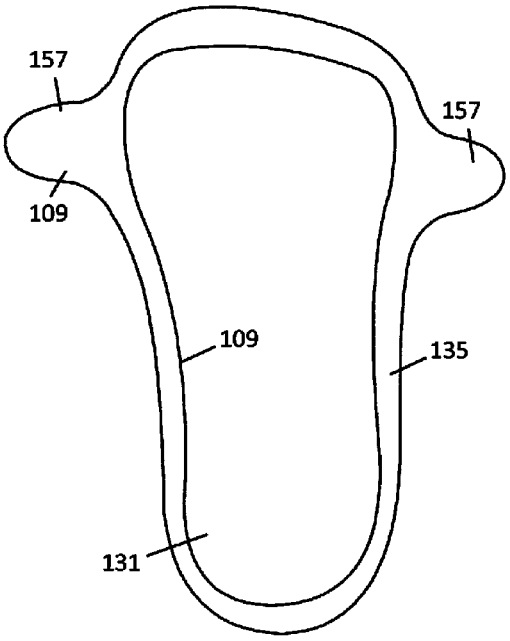
Figure 6:
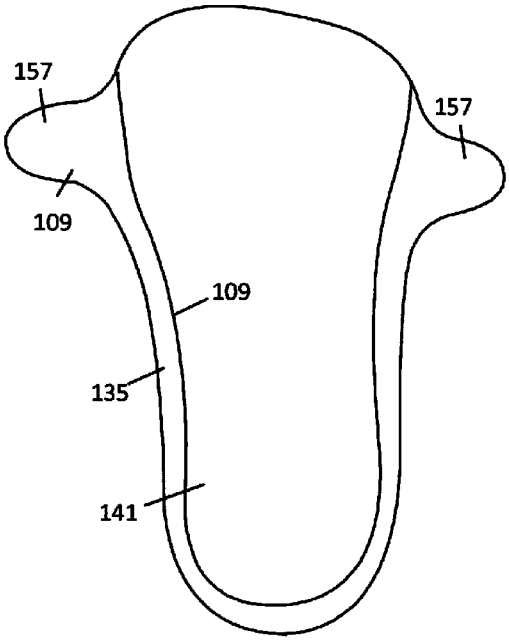

With reference to FIGS. 5 and 6, in an embodiment, the footwear can include tabs 157 that extend to the lateral border of the fifth metatarsophalangeal (MTP) joint and the first MTP joint. The tabs 157 can wrap around and the inner surfaces of the tabs 157 can include adhesive surfaces 109. The tabs 157 can be adhesively secured to the sides of the foot to further increase the stability of the footwear on the user's foot.

Figure 7:
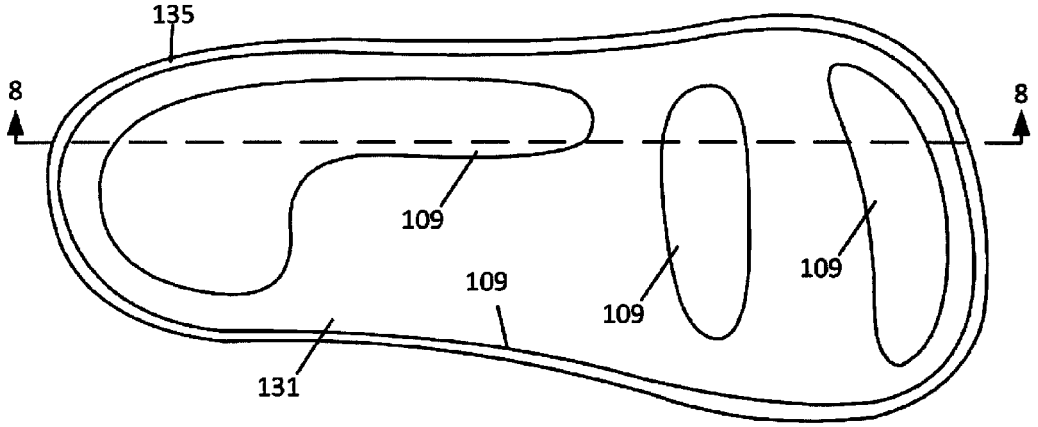
FIG. 7 illustrates a top view of an embodiment of the inventive footwear.
Figure 8:
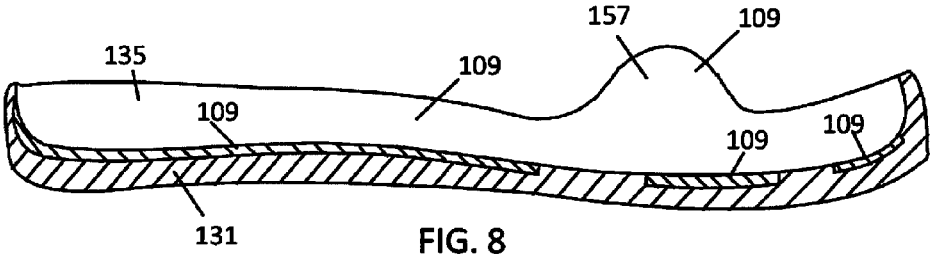
FIG. 8 illustrates a cross sectional side view of an embodiment of the inventive footwear.
Figure 9:
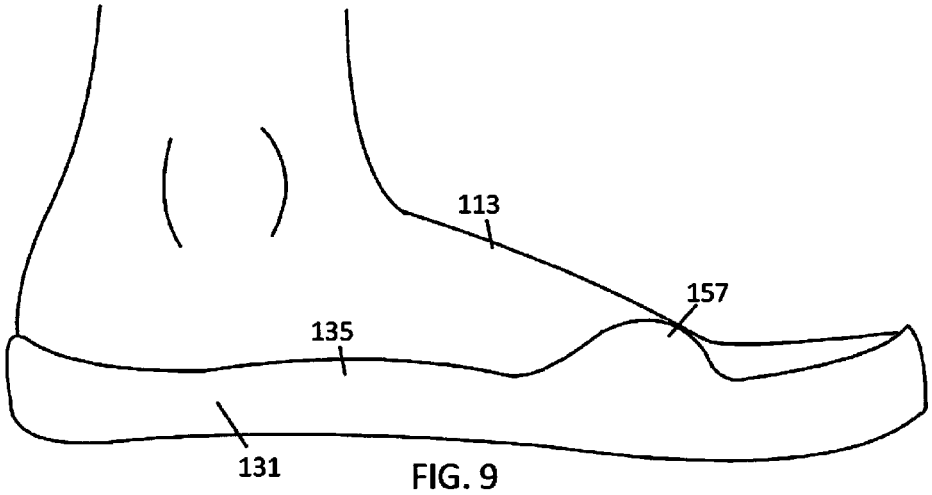
FIG. 9 illustrates a side view of a foot wearing an embodiment of the inventive footwear.

With reference to FIGS. 7-9, in another embodiment, the upward extending member 135 can extend around the entire perimeter of the protective layer 131. FIG. 7 illustrates a top view of the protective layer 131. In this embodiment, one of the adhesive regions 109 includes the heal and lateral side of the foot, a second adhesive region 109 includes the region under the MTP joints of the foot and a third adhesive region 109 includes an area where the bottoms of the toes contact the upper surface of the protective layer 131. FIG. 8 illustrates a cross section view of the protective layer 131. The adhesive regions 109 can be placed within recessed spaces 108 in the upper surface of the protective layer 131 so that the upper surfaces of the adhesive regions 109 and the upper surface of the protective layer 131 are flush and substantially at the same height. The upward extending member 135 can have adhesive regions 109 on the inner surfaces facing the foot that can secure the footwear to the foot 113 above the plantar surface. FIG. 9 is a side view of a foot 113 wearing the inventive footwear. This configuration may be preferred for hiking or walking in areas in which loose bodies can enter the interface between the footwear and the foot 113. The added protection around the front of the foot 113 can prevent particles from falling between the foot 113 and the protective layer 131.

Figure 10:
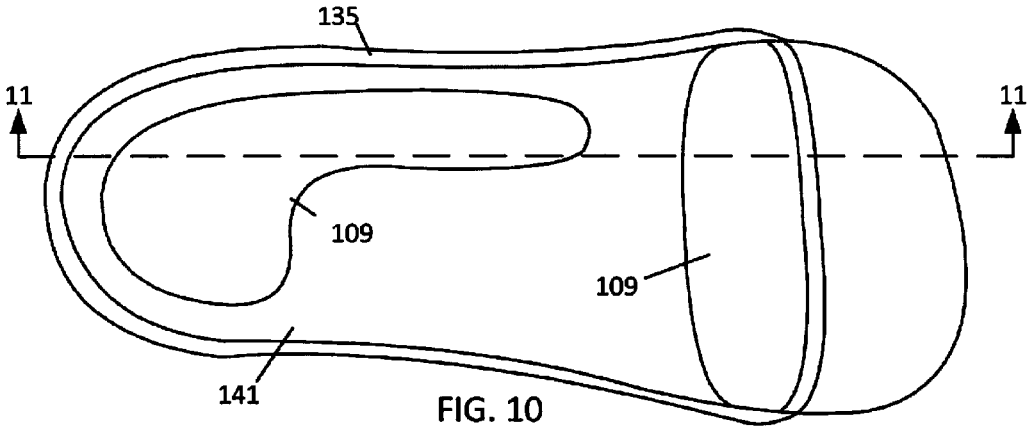
FIG. 10 illustrates a top view of an embodiment of the inventive footwear.
Figure 11:
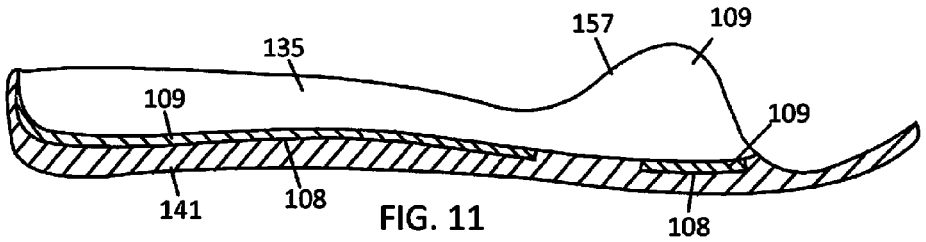
FIG. 11 illustrates a cross sectional side view of an embodiment of the inventive footwear.
Figure 12:
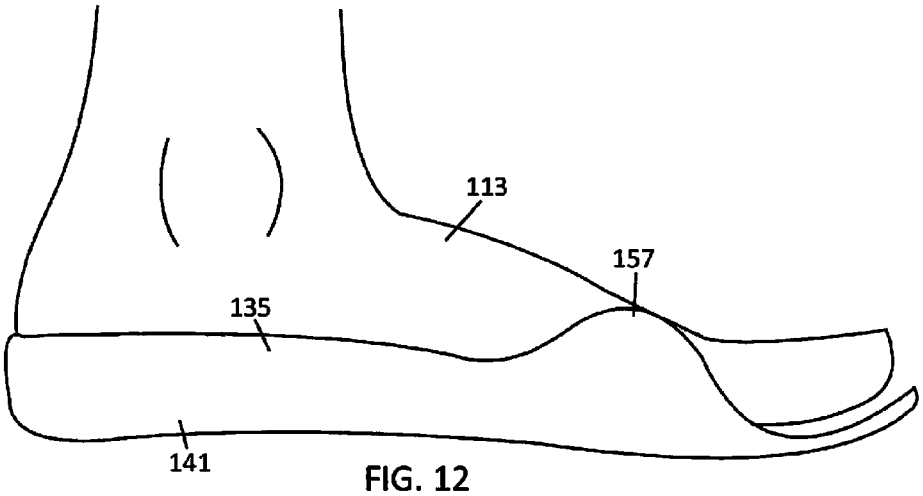
FIG. 12 illustrates a side view of a foot wearing an embodiment of the inventive footwear.

With reference to FIGS. 10-12, in an embodiment, the inventive footwear with the peripheral upward extending members 135 can be used in wet or sandy environments. FIG. 10 illustrates a top view of the protective layer 141 with adhesive regions 109 on the heel area and the lateral side and the region under the first through fifth MTP joints. FIG. 11 illustrates a cross sectional view of the protective layer. In the illustrated embodiment, the protective layer 141 has recessed spaces and the adhesive regions 109 can be inlayed within the recessed spaces 108. FIG. 12 illustrates a side view of a foot 113 in the inventive footwear. The upward extending member 135 can have adhesive regions 109 on the inner surfaces that can border the foot circumferentially except for the forefoot end. Tabs 157 can be attached to the upward extending member 135 adjacent to the first and fifth MTP joints. Other adhesive regions 109 can cover the heel and a lateral side of the foot and extend across the width of the protective layer 141 beneath the region of the MTP joints. The adhesive region 109 can end just distal to the "ball of the foot." The upper surface of the protective layer forward of the MTP joins can be free of adhesive regions 109. This can allow free motion of the toes without encumbrance. The toes can be freely positioned above the front of the protective layer while the remainder of the plantar surface of the foot can be protected from exposure to fluid or sand particles by the adhesive regions 109. This configuration allows users to get their toes wet and sandy but provides both adherence and seals the rest of the foot from exposure.

Figure 13:
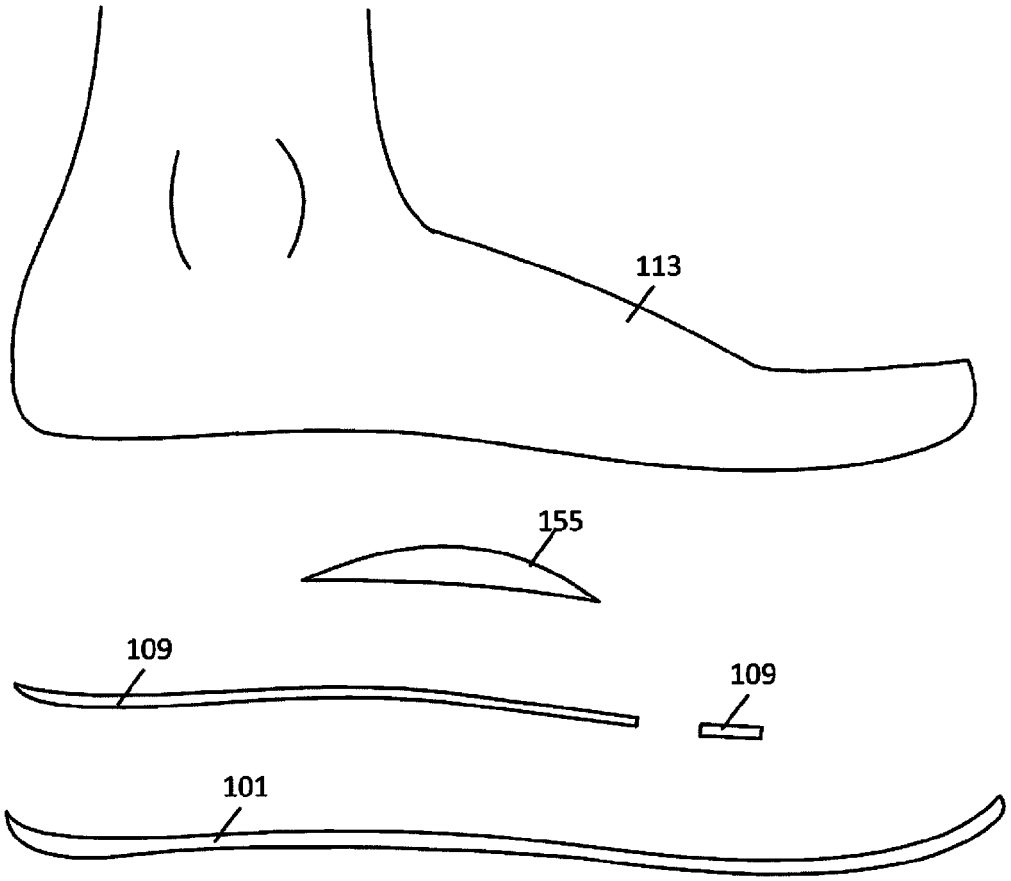
FIG. 13 illustrates an exploded side view of an embodiment of the inventive footwear.
Figure 14:
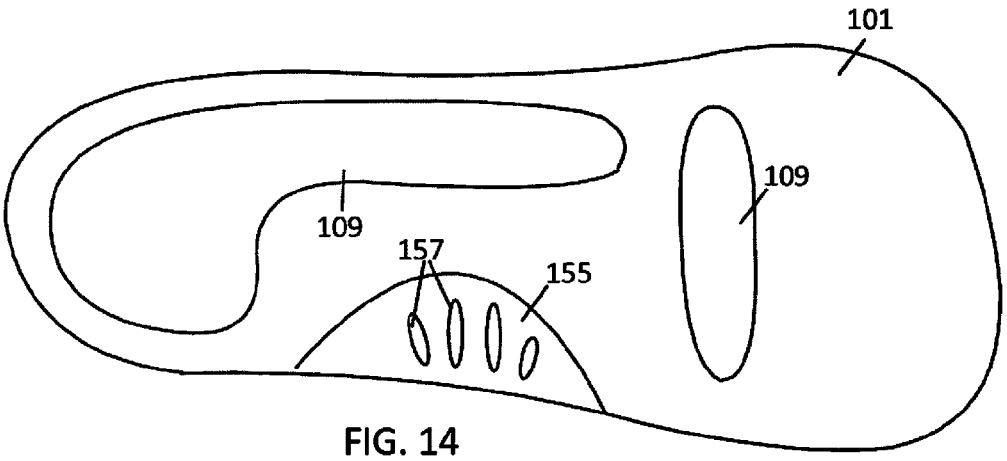
FIG. 14 illustrates a top view of an embodiment of the inventive footwear.

In an embodiment, the arch can have a convex upper exposed surface that is built into the upper surface of the protective layer. However, in other embodiments, the arch can be a modular structure that can be selected to properly fit the arch of the user and secured to the upper surface of the protective layer. With reference to FIG. 13, an exploded side view of a protective layer 101, adhesive regions 109, a modular arch 155 and a foot 113 are illustrated. The arch 155 and the adhesive regions 109 can be adhesively bonded to the protective layer 103. FIG. 14 illustrates a top view of the upper surface 103 of the protective layer 101 with the adhesive regions 109 and the modular arch 155 attached to the upper surface of the protective layer 103.

The arch of the foot can go through a dynamic transformation during gait and running. At heel strike, the arch 155 can be stretched longitudinally and then the arch can progressively collapse through gait in the longitudinal plan. The arch 155 can be made of an elastic material and may include a plurality of fenestrations 157 that allow the arch 155 to stretch and compress more easily. The fenestrations may be arranged in a radial pattern extending outward from the lateral side of the arch. In an embodiment, the inventive footwear can apply dynamic structures such that an arch 155 of the shoe that allows for expansion at heel strike and collapse through other portions of gait to minimize any shear forces that may be transmitted by the footwear to the skin surface on the arch of the foot.

Figure 15:
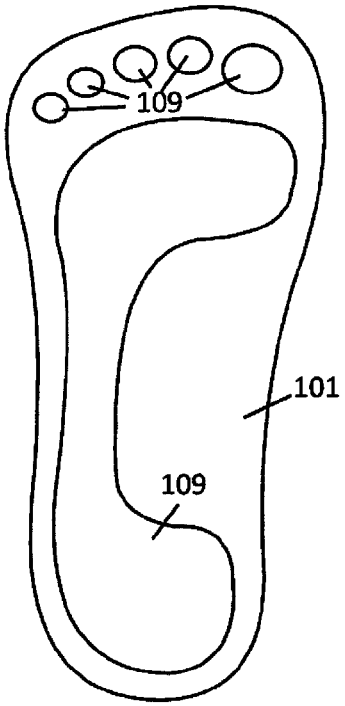
FIGS. 15-18 illustrate top views of different embodiments of the inventive footwear having different adhesive region configurations.
Figure 16:
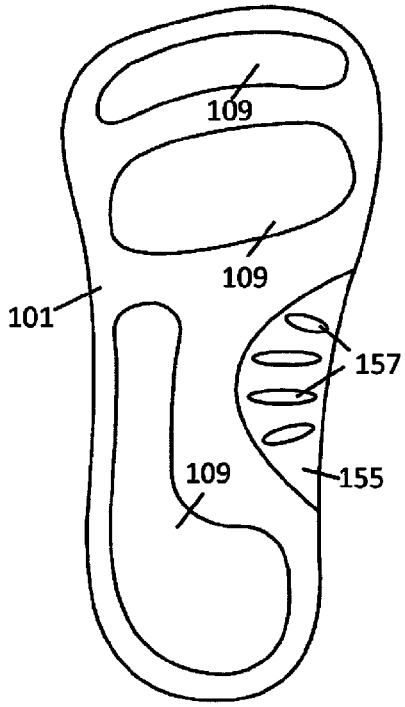
Figure 17:
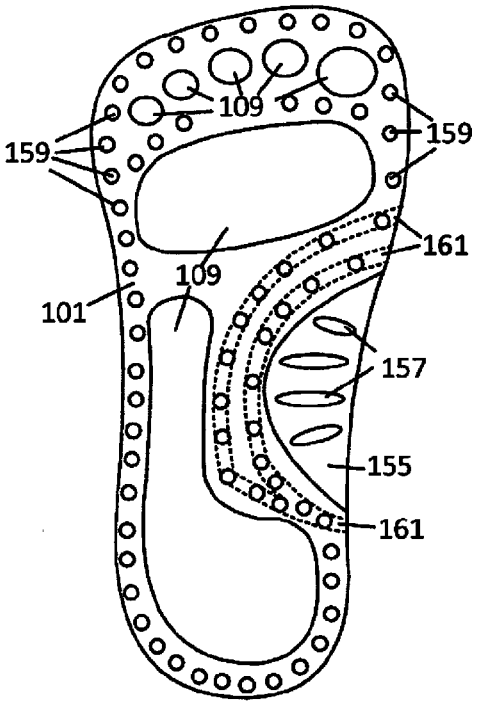
Figure 18:
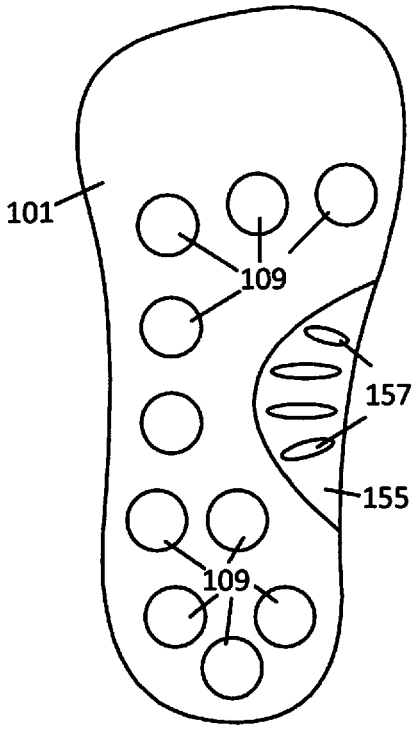

In different embodiments, the inventive footwear can include various combinations of features. With reference to FIGS. 15-18, different embodiments of the upper surface of the inventive footwear are illustrated. With reference to FIG. 15, the adhesive regions 109 include individual toe contact points that can each be substantially circular in shape and a single adhesive region 109 that includes the heel, the lateral side of the foot and the area under the MTP joints on the upper surface of the protective layer 101. With reference to FIG. 16 the adhesive regions 109 include a single region that extends under the toe contact points, a region under the MTP joints and a region under the heel and lateral side of the foot. An arch support 155 having fenestrations 157 can be coupled to the upper surface of the protective layer 101. With reference to FIG. 17, in an embodiment, the upper surface the protective layer 101 can include ventilation holes 159 that extend partially or completely through the protective layer 101. This embodiment of the present invention can include channels 161 that extend through the thickness of the protective layer 101 in a path that can be parallel to the upper surface of the protective layer 101. These holes and fluid flow paths through the protective layer 101 can allow the footwear to have improved breathability and water drainage.

Although the adhesive regions have been illustrated as having shapes that correspond to specific anatomical features that can fit into recesses in the upper surface of the protective layer, in other embodiments, the adhesive regions 109 can be uniform in shape. For example, with reference to FIG. 18, the adhesive regions 109 are circular in shape. In this embodiment, the adhesive regions can be placed on the protective layer 101 in positions selected by the user to provide the desired adhesion to the foot. In an embodiment, the adhesive regions 109 can be modular adhesive pads. As the adhesive regions 109 wear or lose their adherent properties, the modular adhesive regions 109 can be replaced. The adhesive regions 109 can be double-sided adherent pads that may be elastic and compressible to conform to the surface of the foot and be replaced to preserve the longevity of the footwear. In other embodiments, the adhesive regions 109 can be thin double-sided adherent pads that may not be significantly elastic or compressible.

Figure 19:
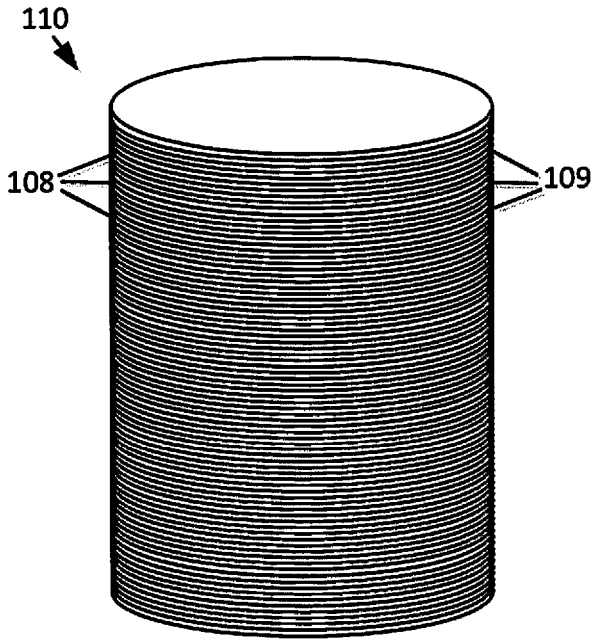
FIG. 19 illustrates a stacked structure of adhesive regions.

With reference to FIG. 19, the adhesive regions 109 can be stored in a stacked configuration 110 which can be a cylindrical or other elongated structure. The user can remove the individual adhesive regions 109 and placed them on the protective layer 101 as they are needed. In an embodiment, the individual adhesive regions 109 can be separated by release layers 108 of wax paper or silicone release coated paper which prevents the adhesive regions 109 from sticking to each other. Although the adhesive regions 109 are illustrated in FIG. 19 are illustrated as being circular in shape, in other embodiments, the adhesive regions 109 can be any other suitable uniform shape including: ovals, polygons, etc. This invention describes the use of modular pads. As the adherent regions 109 wear or lose their adherent properties, the adherent regions 109 can be removed and replaced. This invention describes the use of double sided adherent pads that can be replaced to preserve the longevity of the overall shoe.

Figure 20:
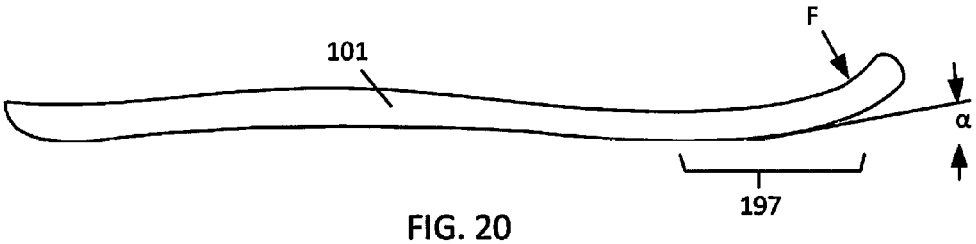
FIGS. 20-21 illustrate side views of an embodiment of the protective layer.
Figure 21:
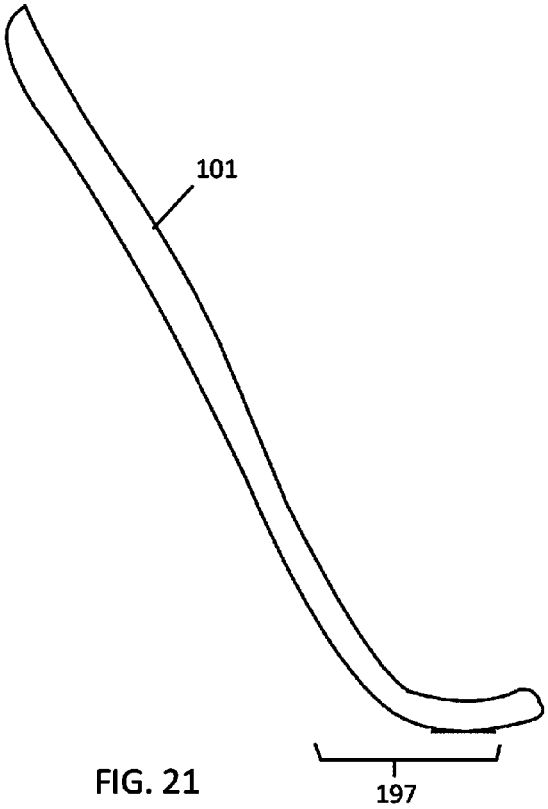

The angle and conformation of the footwear is also critical in order to prevent biomechanical difficulties during the various phases of user's gait. Specifically, flat adherent footwear can cause problems for the user during the "toe off" phase of gait and can lead to altered gait patterns. For example, a steppage gait has been observed in users with flat adherent design footwear. In an embodiment with reference to FIGS. 20 and 21, the inventive footwear can include an asymmetric dorsiflexion mechanism 197 built into the protective layer 101 that extends from the level of MPT joints to the distal portion of the footwear in the region of the toes. The dorsiflexion can be asymmetrically flexible to allow the forefoot toe portion of the protective layer 101 to bend upwards from a normal angle $\alpha$ between the forefoot and the rear foot sections as shown in FIG. 21. From the upward bent position, the toes can exert downward force and the foot can then leave the ground. During the next step, the forefoot can be returned to its normal position, shown in FIG. 20. In a preferred embodiment, the forefoot region cannot bend downward from the original angle $\alpha$ relative to the rear foot region. In an embodiment, the original angle $\alpha$ is greater than or equal to 10 degrees. This inflexibility can keep the toes up and prevent the front of the footwear from accidentally rolling under the lower surface of the protective layer which can leave the toes exposed. However, in other embodiments, the flexibility acts as a spring and allows the toes to overpower the upward spring force of the dorsiflexed toe plate so that the angle becomes less than a. This flexibility can function to support more dynamic activities such as running.

Figure 22:
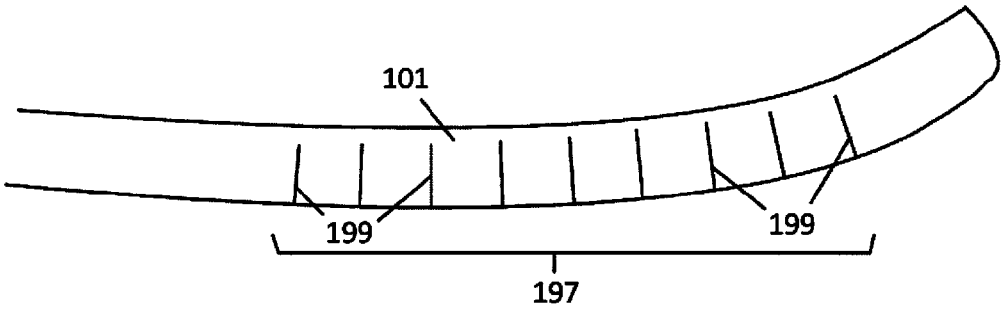
FIGS. 22-23 illustrate side view of an embodiment of an asymmetric dorsiflexion mechanism.
Figure 23:
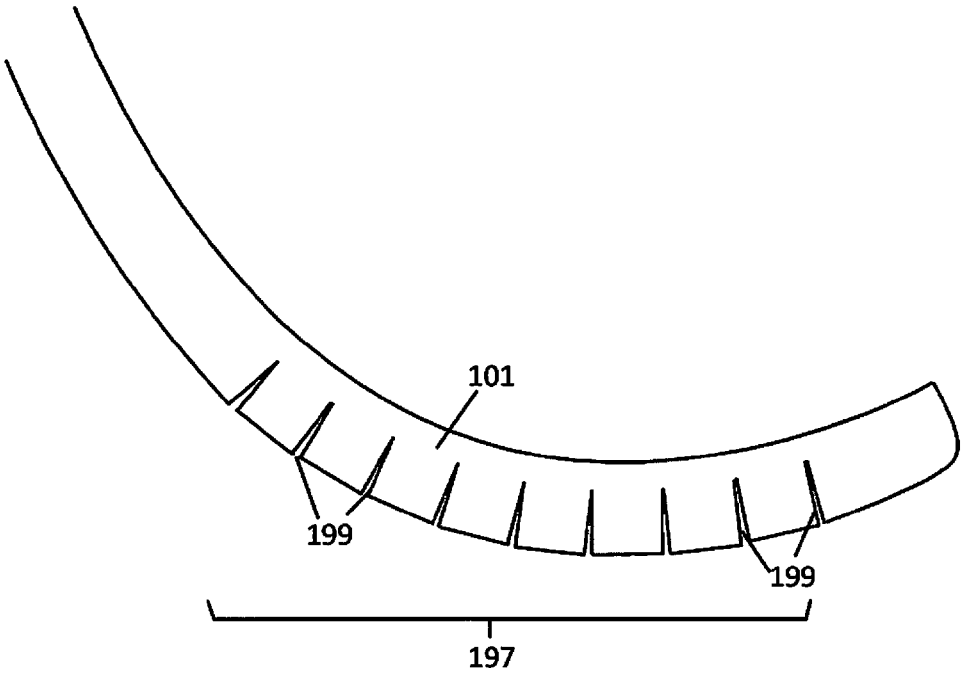

With reference to FIGS. 22 and 23, an embodiment of an asymmetric dorsiflexion mechanism 197 is illustrated. FIG. 22 illustrates the protective layer 101 from the level of MPT joints to the distal portion. The asymmetric dorsiflexion mechanism 197 can include a plurality of thin grooves or cuts 199 that extend partially through the thickness of the protective layer 101 and run across the width of the protective layer 101. When the user presses down on the toe portion of the protective layer 101, the thin grooves or cuts 199 cannot compress and resist the movement of the toes. However, when the toe portion of the protective layer 101 rotates upward, the grooves or cuts 199 are able to open and the asymmetric dorsiflexion mechanism 197 can allow the protective layer 101 to bend.

Figure 24:
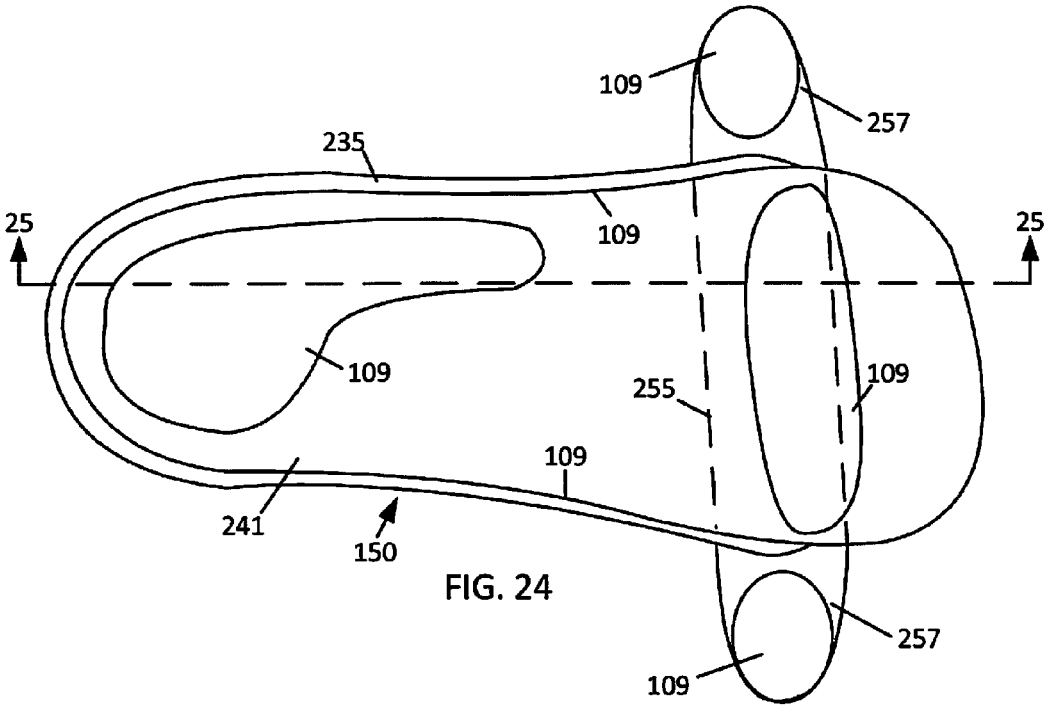
FIG. 24 illustrates a top view of an embodiment of the inventive footwear with replaceable tabs.
Figure 25:
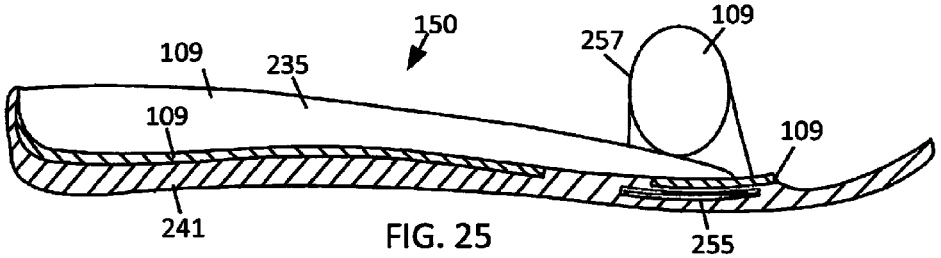
FIG. 25 illustrates a cross section side view of an embodiment of the inventive footwear with replaceable tabs.

As discussed, the tab structure can be a replaceable structure that can be used to secure the footwear to the foot. With reference to FIGS. 24 and 25, the tab 257 can be a replaceable structure having adhesive regions 109 that can be wrapped over and can be secured to the sides and top of the foot. FIG. 24 shows a top view of an embodiment of the inventive footwear 150 having a protective layer 241, a raised edge 235 and adhesive regions 109. In this embodiment, the tab 257 can be made of a single flexible high tensile strength material that passes through a hole or slot 255 that runs through the width of the protective layer 241. FIG. 25 shows a cross sectional side view of the footwear 190. In the illustrated embodiment, the center portion of the tab 257 can be placed through the hole or slot 255 and held is the desired position with an adhesive or mechanical fastener. If the tab 257 breaks or wears out, it can be removed from the hole or slot 255 and a new tab 257 can be placed through the hole or slot 255 to replace the worn or broken tab 257.

Although the tab 257 is shown as a single piece structure, in other embodiments, the footwear can have two separate tab structures. One tab can extend out of each of the exits of the hole or slot 255. One end of the tab can be placed in the hole or slot 255 and the other end can extend from the side of the protective layer and wrapped over the foot. When one tab needs to be replaced, the individual tab can be removed from the hole or slot 255 and replaced while the remaining tab can remain attached to the protective layer.

Figure 26:
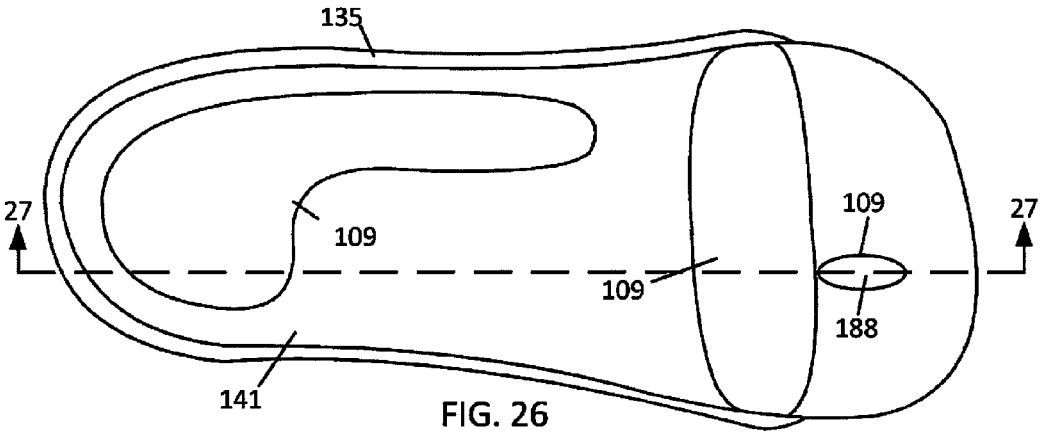
FIG. 26 illustrates a top view of an embodiment of the inventive footwear having a toe tab.
Figure 27:
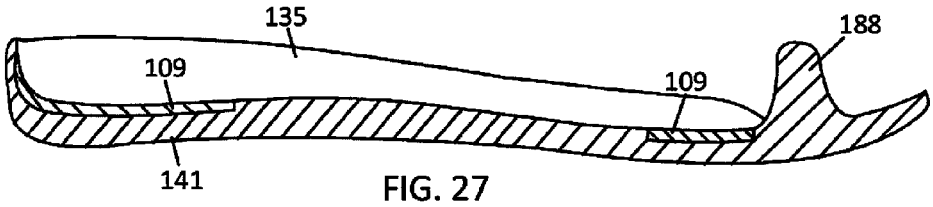
FIG. 27 illustrates a side cross section view of an embodiment of the inventive footwear having a toe tab.
Figure 28:
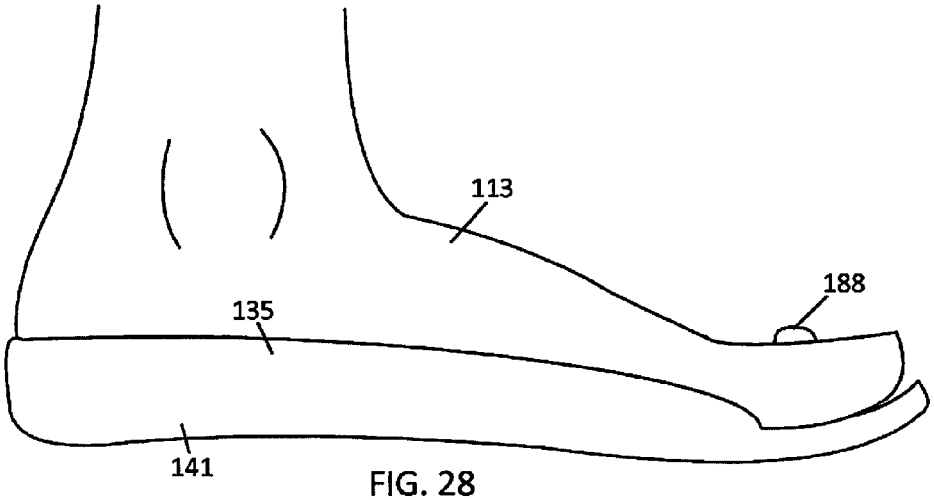
FIG. 28 illustrates a side view of a foot wearing an embodiment of the inventive footwear having a toe tab.

With reference to FIGS. 26-28, in another embodiment, the inventive footwear can have a toe tab 188 can be rigidly attached to the upper surface of the protective layer 141. The toe tab 188 can extend upward from the protective layer 141 between the big toe and the second toe. The outer surfaces of the toe tab 188 can be covered with an adhesive region 109 so that the toe tab 188 is coupled to the webbing of the inner surfaces between the big toe and the second toe. FIG. 26 illustrates a top view of the protective layer 141 with the toe tab 188 having an elongated oval cross section. FIG. 27 illustrates a cross section of the footwear. In an embodiment, the toe tab 188 can be integrated with the protective layer 141. However, in other embodiments, the toe tab 188 can be modular and replaceable. FIG. 28 illustrates a side view of a foot 113 wearing the footwear with the top of the toe tab 188 extending above the tops of the toes.

Figure 29:
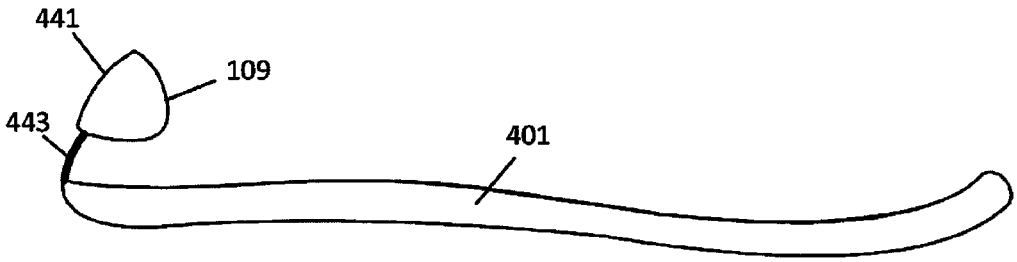
FIG. 29 illustrates a side view of an embodiment of the inventive footwear having a heel tab.
Figure 30:
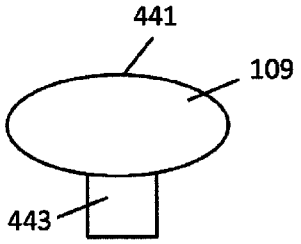
FIGS. 30 and 31 illustrate views of an embodiment of the heel tab.
Figure 31:
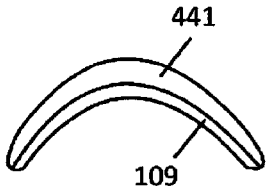
Figure 32:
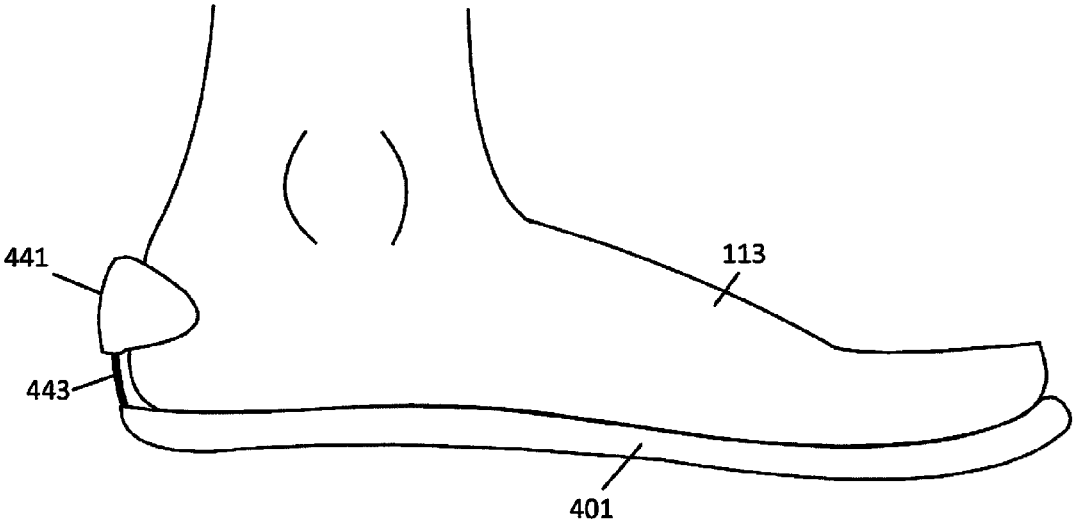
FIGS. 32 and 33 illustrate side views of embodiment of a user's foot wearing the inventive footwear having a heel tab.
Figure 33:
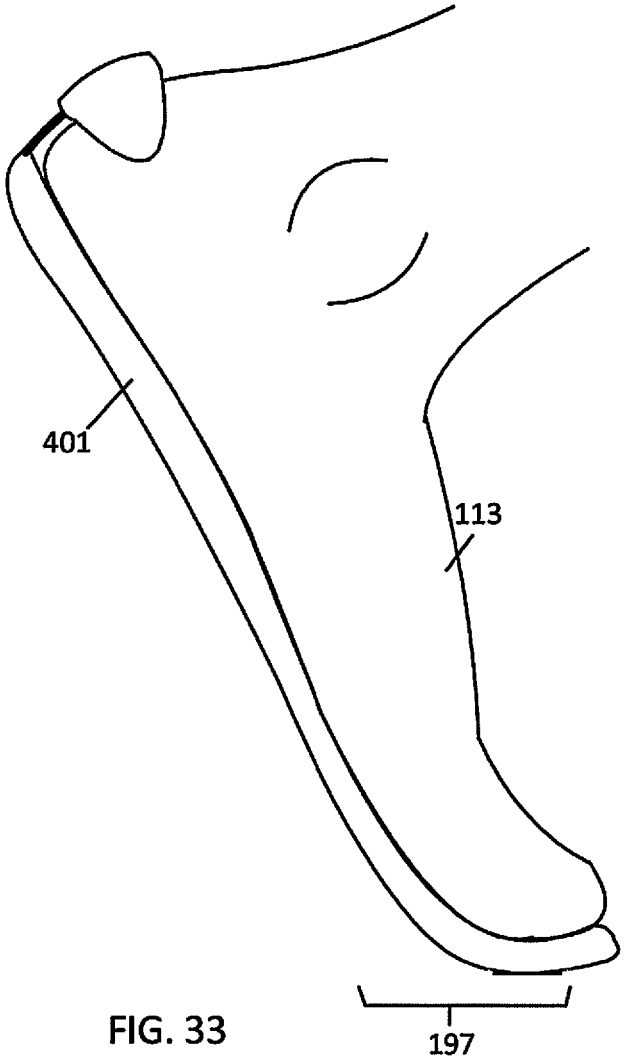

The inventive footwear has been described as relying upon adhesive regions on the protective layer to secure the footwear to the foot. However, with reference to FIGS. 29-33, a heel tab mechanism can be used to improve the adhesion of the heel portion of the footwear to the foot. FIG. 29 illustrates a side view of a protective layer 401 having a heel tab 441 coupled to the heel portion with a spring mechanism 443. FIG. 30 illustrates a heel facing view of the heel tab 441 having an adhesive region 109 on the inner surface. FIG. 31 illustrates a top view of the heel tab 441 showing the curvature and the adhesive region 109 on the inner surface. The heel tab 441 can have rounded edges and surfaces. FIG. 32 shows a foot 113 on the protective layer 401 with the heel tab 441 attached to the heel of the foot 113. The spring mechanism 443 can compress the heel tab 441 against the heel of the foot 113. The protective layer 401 can have the same adhesive regions 109 on the upper surface as shown in FIGS. 1 and 2. These adhesive regions 109 can be very good at preventing horizontal movement of the foot 113 relative to the protective layer 401. However, it can be more difficult to hold the protective layer 401 against the foot 113 as the heel rises. The bending of the protective layer 401 can generate a force that can tend to pull the protective layer 401 away from the heel of the foot 113. Thus, the connection of the heel tab 441 to the heel of the foot 113 can prevent this separation. With reference to FIG. 33, a side view of the foot 113 with a raised heel is illustrated. The heel tab 441 helps to hold the heel of the protective layer against the foot 113. In other embodiments, the illustrated heel tab 441 can be used with other types of footwear including sandals and flip-flops.

Figure 34:
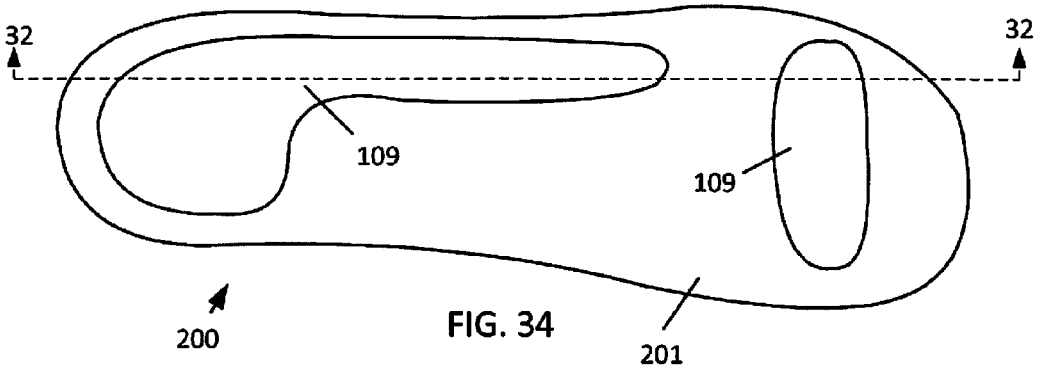
FIG. 34 illustrates a top view of a high heel embodiment of the inventive footwear.
Figure 35:
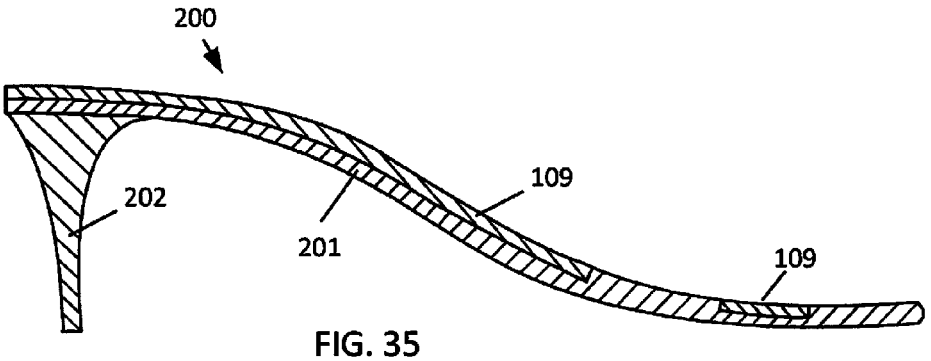
FIG. 35 illustrates a cross sectional side view of a high heel embodiment of the inventive footwear.
Figure 36:
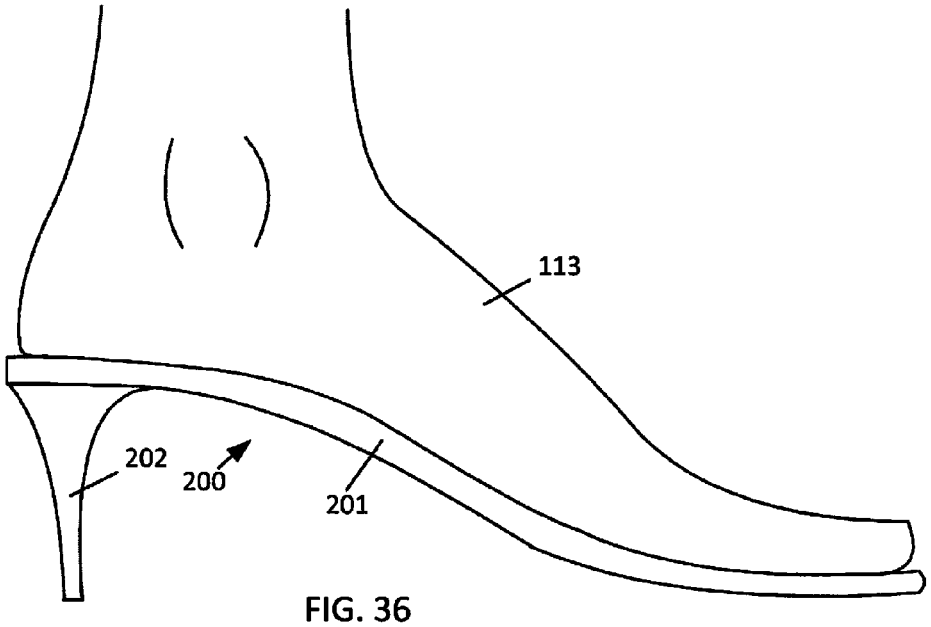
FIG. 36 illustrates a side view of a high heel embodiment of the inventive footwear on a foot.

The inventive footwear has been described as being used with flat high performance unfashionable applications. However, in other embodiments, the inventive adhesive regions 109 can be used with more aesthetically pleasing high heel footwear 200 as shown in FIGS. 34-36. FIG. 34 illustrates a top view of the high heel footwear 200 with the protective layer 201 and the adhesive regions 109 on the upper surface of the protective layer 201. FIG. 35 illustrates a cross sectional side view of the footwear 200. The adhesive regions 109 can be placed in recessed spaces in the upper surface of the protective layer 201. The heel 202 can raise the rear portion of the footwear 200. The protective layer 201 can be made of a more rigid high strength material which can support the weight of the user between the heel 202 and the forefoot section of the footwear 200. FIG. 36 illustrates a side view of the footwear 200 being worn on a foot 113. Because of the adhesive regions 109, straps are not required to hold the footwear 200 to the foot 113. However, in other embodiments, ornamental straps can be used with the footwear 200.

The present invention utilizes adhesive regions to attach the footwear to the foot. Various different adhesives can be used with the inventive footwear. In an embodiment, a "gecko" adherence technology can be used which does not require the use of traditional tack adhesives. The adherent zone can comprise microstructures that have extensive surface area due to the size and number of microscopic hair like structures. The surface area generates Van der Waal forces sufficient for two surfaces to adhere to each other. There are numerous advantages to Van der Waal adherent technology. If a "tack adhesive" is not used, there is no residue which can be left on either of the bonding surfaces. The bonding performance is maintained indefinitely. In contrast, the bonding performance of tack adhesives can degrade readily or only be appropriate for limited on off cycles. Tack adhesives can also require the use of chemicals and require a separate layer of material for holding the tack adhesive.

However, many tack adhesives are specifically designed for bonding to human skin. In particular, many adhesives are specifically designed for medical applications and are specifically formulated to avoid skin irritation and allergic reactions. An example of a suitable tack adhesives that can be used in the adhesive regions of the inventive footwear is 3M Medical Specialties Product Number 1504XL, Hi Tack Medical Transfer Adhesive on Extended Liner. This adhesive is a synthetic rubber and resin system that can be applied to opposite sides of a thin plastic film and cut to the required shapes of the adhesive regions. The bonding properties of this adhesive can be measured by attaching the adhesive to stainless steel and measuring the force required to remove the adhesive with a 90 degree peel. The nominal force required to remove the adhesive is 5.7 kg/25.4 mm width of adhesive.

Figure 37:
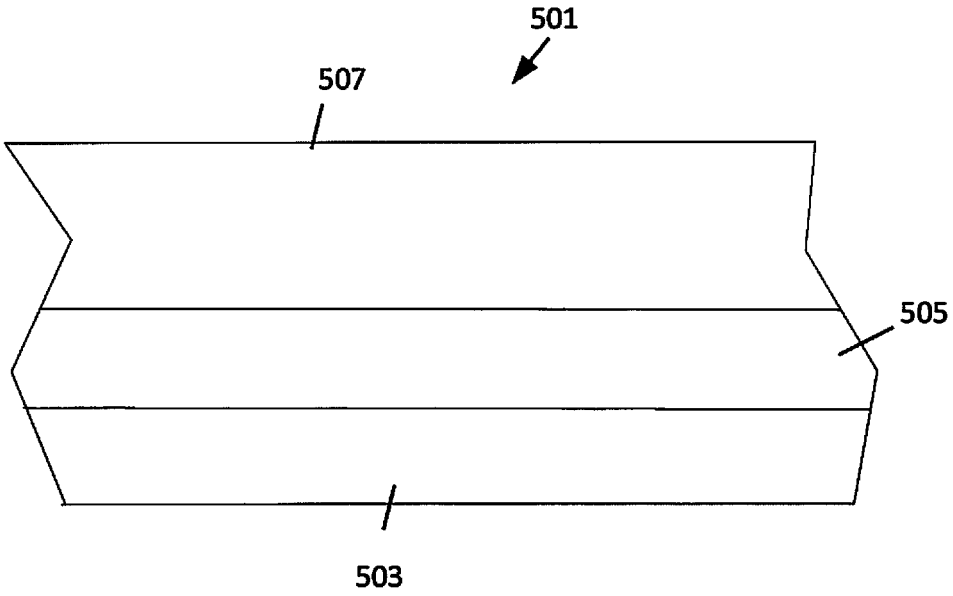
FIG. 37 illustrates a side view of an embodiment of a two sided tape that can be used for the adhesive regions.

In another embodiment, 3M Medical Specialties Product Number 1577, Two-in-One Polyester Double Coated Tape can be used for the adhesive regions. A side view of this tape 501 is illustrated in FIG. 37. The tape 501 can use two types of adhesives coated on opposite sides of a carrier polyester film 505. A synthetic rubber adhesive 503 can be used to secure the adhesive region to the upper surface of the protective layer and the inner surfaces of the raised edges or tabs. An acrylic adhesive 507 can be used to secure the adhesive region to the skin of the user of the footwear. In this embodiment, the two adhesives can have different bonding properties. The synthetic rubber adhesive 503 can require a nominal force of 2.8 kg/25.4 mm width of adhesive and the acrylic adhesive 507 can require a nominal force of 1.5 kg/25.4 mm width of adhesive. This configuration can cause the synthetic rubber adhesive regions to be more aggressively bonded to the protective layer than the foot so that the adhesive regions will remain in place on the footwear when the foot is removed. The synthetic rubber adhesive 503 may also be thinner than the acrylic adhesive 507. Because the upper surface of the protective layer can be smooth, the contact area between the protective layer and the synthetic rubber adhesive 503 can be very high since the adhesive 503 does not need to conform to an uneven topography. In contrast, the acrylic adhesive 507 may need to elastically conform to the skin surface which can be an uneven surface. A thicker layer of acrylic adhesive 507 can allow a better interface between the skin and the adhesive 507. In other embodiments, any other suitable materials can be used for the adhesive regions.

The protective layers described above, can be many of various rigid or elastic materials. The bottom surface of the protective layer preferably has a non-skid tread which provides traction on the surfaces that the footwear is being used. The protective layer should be able to protect the foot from sharp objects and may also provide some cushioning for the foot to reduce the impact while performing activities such as running on pavements. As discussed, the thickness of the protective layer can be variable with a thicker section at the heel and a thinner more flexible construction at the forefoot portion. The protective layer can be made of multiple materials. For example, the bottom surface can be a strong wear resistant rubber material layer that provides the tread for the footwear. A layer of foam or other elastic material can be attached over the rubber material to provide cushioning for the foot. The upper surface of the protective layer can be made of a smooth material that is comfortable against the plantar surface of the foot.

The upper surface of the protective layer may have a shape that conforms to the contours of the planar surface of the user's foot. The topography of the upper surface of the protective layer may be a custom product based upon actual surface measurements of the user's foot or may correspond to a generic shape based upon the size of the user's foot. The lower surface can have a flatter profile across the width to provide better stability and a larger contact area for improved traction.

Although footwear has been described, the present invention can also be used for other functionality. For swimming, webbing extensions using the described adhesive regions increase the forces that can be applied to the feet for swimming apparatus such as adherent flippers for swimming, scuba and snorkeling. Adherent flippers can include adherent sections applied to the dorsum of the foot or forefoot to avoid separation from the foot during the upstroke portion of the swimming motion. The inventive adhesive regions can eliminates the need for a heel strap on the flippers and allows for a more conforming forefoot design.

The inventive adhesive regions on a protective layer of footwear can also be applied to other types of shoes. In an embodiment, the footwear can include abrasion resistant coverings for protecting the toes which can be part of specialty shoes used for activities such as ballet and rock climbing. In other embodiments, the protective layer of the inventive footwear can be very stiff in order to transmit more leg energy for activities such as skiing, crew and cycling. This special footwear can be equipped with specific types of cleats which can be locked into corresponding sport specific binding mechanisms. For some footwear spikes or other protruding mechanisms can be attached to the bottom of the protective layer.

It will be understood that the inventive system has been described with reference to particular embodiments, however additions, deletions and changes could be made to these embodiments without departing from the scope of the inventive system. Although the order filling apparatus and method have been described include various components, it is well understood that these components and the described configuration can be modified and rearranged in various other combinations and configurations.

What is claimed is:

1. A footwear apparatus comprising:

a protective layer having a lower surface and an upper surface;

a plurality of recessed regions in the upper surface of the protective layer;

a raised edge that extend upward from the protective layer having an inner surface and an outer surface; and a plurality of adhesive regions within at least some of the recessed regions of the protective layer and at least some of the adhesive regions are attached to the inner surfaces of the raised edge, wherein the adhesive regions adhesively couple the protective layer and the raised edge to a foot.

2. The footwear apparatus of claim 1 wherein a first of the plurality of adhesive regions adhesively couple the upper surface of the protective layer to a heel portion of the foot.

3. The footwear apparatus of claim 1 wherein a first of the plurality of adhesive regions adhesively couple the upper surface of the protective layer to a ball portion of the foot.

4. The footwear apparatus of claim 1 wherein none of the plurality of adhesive regions are on an arch portion of the protective layer.

5. The footwear apparatus of claim 1 wherein none of the plurality of adhesive regions are on a toe portion of the protective layer.

6. The footwear apparatus of claim 1 further comprising: tabs that extend upward from the raised edge.

7. The footwear apparatus of claim 6 wherein some of plurality of adhesive regions are on the inner surfaces of the tabs.

8. The footwear apparatus of claim 6 wherein the raised edge does not extend around a toes portion of the protective layer.

* * * * *